US010667976B2

(12) United States Patent
Scott et al.

(10) Patent No.: US 10,667,976 B2
(45) Date of Patent: Jun. 2, 2020

(54) LOW CLEARANCE MEDICAL IMAGING CHAIR

(71) Applicant: Medical Positioning, Inc., Kansas City, MO (US)

(72) Inventors: David P. Scott, Kansas City, MO (US); Ghassan G. Dinn, Kansas City, MO (US)

(73) Assignee: Medical Positioning, Inc., Kansas City, MO (US)

( * ) Notice: Subject to any disclaimer, the term of this patent is extended or adjusted under 35 U.S.C. 154(b) by 564 days.

(21) Appl. No.: 15/165,812

(22) Filed: May 26, 2016

(65) Prior Publication Data

US 2016/0346144 A1 Dec. 1, 2016

Related U.S. Application Data

(60) Provisional application No. 62/167,555, filed on May 28, 2015.

(51) Int. Cl.

| | |
|---|---|
| ***A61G 15/02*** | (2006.01) |
| ***A61G 7/012*** | (2006.01) |
| ***A61G 7/16*** | (2006.01) |
| ***A61G 7/05*** | (2006.01) |

(52) U.S. Cl.

CPC ..... *A61G 15/02* (2013.01); *A61G 7/012* (2013.01); *A61G 7/0528* (2016.11); *A61G 7/16* (2013.01)

(58) Field of Classification Search

CPC ..... A61G 15/02; A61G 7/16; A61G 7/0528; A61G 7/012

See application file for complete search history.

(56) References Cited

U.S. PATENT DOCUMENTS

| | | | | | |
|---|---|---|---|---|---|
| 3,142,351 | A * | 7/1964 | Green | A61G 5/061 | 180/8.2 |
| 4,199,829 | A * | 4/1980 | Watanabe | A61G 7/1003 | 5/87.1 |
| 4,376,317 | A * | 3/1983 | Johnston | A61G 7/015 | 5/601 |
| 4,693,490 | A * | 9/1987 | Loodberg | A61G 5/08 | 280/250.1 |
| 4,770,432 | A * | 9/1988 | Wagner | A61G 5/08 | 280/250.1 |
| 4,817,220 | A * | 4/1989 | Guttormsem | A61G 7/012 | 108/145 |
| 5,926,876 | A * | 7/1999 | Haigh | A61G 13/12 | 5/616 |
| 5,950,262 | A * | 9/1999 | Smoler | A61G 13/0018 | 188/5 |
| 6,499,163 | B1 * | 12/2002 | Stensby | A61G 5/006 | 280/250.1 |
| 7,716,761 | B1 * | 5/2010 | Gilstad | A61G 7/0573 | 5/425 |
| 8,465,091 | B2 * | 6/2013 | Su | A47C 17/04 | 297/108 |
| 8,661,585 | B1 * | 3/2014 | Alasfour | A61G 7/015 | 5/604 |

(Continued)

FOREIGN PATENT DOCUMENTS

| | | | | |
|---|---|---|---|---|
| FR | 726500 A * | 5/1932 | ..... | A47C 20/04 |

*Primary Examiner* — Robert G Santos
*Assistant Examiner* — Alexis Felix Lopez
(74) *Attorney, Agent, or Firm* — Polsinelli PC

(57) ABSTRACT

The present disclosure relates to a medical imaging chair.

18 Claims, 11 Drawing Sheets

(56) References Cited

U.S. PATENT DOCUMENTS 8,793,826 B2 * 8/2014 Nurminen ..... A61G 13/1255 5/617
9,364,375 B2 * 6/2016 Youngmann ..... A61G 5/006
D777,464 S * 1/2017 Siao ..... D6/368
9,597,243 B1 * 3/2017 Helmick ..... A61G 15/02
2001/0032364 A1 * 10/2001 VanSteenburg ..... A61G 13/12 5/621
2005/0029855 A1 * 2/2005 Hanson ..... A61G 5/08 297/440.15
2005/0138731 A1 * 6/2005 Failor ..... A61G 5/006 5/601
2006/0026762 A1 * 2/2006 Hornbach ..... A47C 19/045 5/611
2007/0145789 A1 * 6/2007 Linero ..... A47C 1/122 297/107
2009/0100598 A1 * 4/2009 Bly ..... A47C 20/043 5/510
2010/0005591 A1 * 1/2010 Manouchehri ..... A61G 7/053 5/611
2010/0064439 A1 * 3/2010 Soltani ..... A61G 7/053 5/611
2010/0283296 A1 * 11/2010 Lin ..... A47C 4/24 297/39
2011/0272200 A1 * 11/2011 Clapp ..... A61G 1/017 180/54.1
2011/0272976 A1 * 11/2011 Wei ..... A47C 1/022 297/195.11
2012/0079655 A1 * 4/2012 Tekulve ..... A61G 7/015 5/2.1
2012/0181779 A1 * 7/2012 Tsukada ..... A61G 5/006 280/648
2012/0198631 A1 * 8/2012 Heimbrock ..... A61G 7/0533 5/662
2012/0246830 A1 * 10/2012 Hornbach ..... A61G 7/015 5/619
2013/0007960 A1 * 1/2013 Manouchehri ..... A61G 7/0507 5/618
2013/0318717 A1 * 12/2013 Iheoma ..... A61G 13/00 5/600
2014/0068861 A1 * 3/2014 Jackson ..... A61G 13/04 5/601
2014/0123389 A1 * 5/2014 Hornbach ..... A61G 7/012 5/611
2014/0137328 A1 * 5/2014 Ohta ..... A61G 7/018 5/611
2014/0191541 A1 * 7/2014 Ohta ..... A61G 5/04 297/118
2014/0259412 A1 * 9/2014 Shiery ..... A61G 7/012 5/611
2014/0265497 A1 * 9/2014 Hough ..... A61G 5/14 297/316
2014/0319804 A1 * 10/2014 Tsukada ..... A61G 7/00 280/648
2015/0082537 A1 * 3/2015 Ohta ..... A61G 5/04 5/2.1
2015/0129333 A1 * 5/2015 Morris ..... A61G 1/0275 180/65.8
2015/0135439 A1 * 5/2015 G ..... A61G 7/012 5/611
2015/0196442 A1 * 7/2015 Heil ..... A61G 7/015 5/618
2015/0232185 A1 * 8/2015 Johnson ..... B64D 11/0691 297/14
2015/0290058 A1 * 10/2015 Panzer ..... B66F 3/28 403/109.6
2015/0290061 A1 * 10/2015 Stafford ..... A63B 71/0619 5/600
2015/0297432 A1 * 10/2015 Poulos ..... A61G 5/14 5/610
2015/0313779 A1 * 11/2015 Kume ..... A47C 20/08 5/616
2015/0320627 A1 * 11/2015 Tsukada ..... A61G 5/08 5/613
2015/0335508 A1 * 11/2015 Liu ..... A61G 7/012 5/611
2016/0067127 A1 * 3/2016 Shimada ..... A61G 7/005 5/611
2016/0120327 A1 * 5/2016 Shimada ..... A61G 7/005 5/11
2016/0296388 A1 * 10/2016 Hertz ..... A61G 7/05
2016/0302986 A1 * 10/2016 Haladova ..... A61G 5/006
2018/0185220 A1 * 7/2018 Brosnan ..... H02K 1/146

* cited by examiner

LOW CLEARANCE MEDICAL IMAGING CHAIR

CROSS REFERENCE TO RELATED APPLICATION

This application relates to and claims the priority of U.S. Provisional Patent Application Ser. No. 62/167,555, which was filed May 28, 2015 and is hereby incorporated by reference in its entirety.

FIELD OF THE INVENTION

The present disclosure relates to a medical imaging chair.

BACKGROUND OF THE INVENTION

Mobile medical chairs are extensively used for patient transfer and transport at medical facilities. These chairs have to be multifunctional and adjustable to quickly and safely move a patient from a sitting position to supine positions, and from a lowered position to allow patient access to the chair, to an elevated position to facilitate various medical procedures. Some of these medical chairs are also used in radiographic and fluoroscopic imaging wherein the patient is allowed to remain in the medical chair during such procedures and have to provide radiolucent properties and patient-positioning capabilities to allow for such procedure. To provide such varied use, medical chairs known in the art normally employ a multitude of electronic, mechanical, and safety equipment to facilitate safe positioning and transport of a patient, with maximum comfort and minimum inconvenience to the patient. However, the multitude of equipment required for optimum function of mobile medical chairs are bulky. As such, one or more functions of these chairs is usually restricted to protect the chair or the patient. For instance, guidelines by the Americans with Disabilities Act (ADA) recommend that to be accessible, the height of chairs should be between 16 and 19 inches from the floor. However, to protect chair equipment normally found under the chair seat, chairs currently known in the art cannot be lowered to this height without compromising some functionality or flexibility. Similarly, chairs currently known in the art provide for pivoting armrests mechanisms to facilitate the access for a patient to the chair and to remove the armrests to facilitate access to medical equipment and personnel. However, such armrests limit the movement of the chairs when the armrests are not in an upright position.

As such, there is a need in the art for a multifunctional and adjustable mobile medical chair that is accessible to all patients, including patients with disabilities, and that can provide safe and quick movement of patients.

SUMMARY OF THE INVENTION

In one aspect, the present disclosure provides a low clearance mobile medical chair comprising a base, a patient support structure, and a lift mechanism extending upwardly from the base and coupling the base to the patient support structure, wherein the lift mechanism comprises an actuator that functions to adjust the height of the patient support structure.

The patient support structure comprises a seat section, a back rest, and a leg support section. The leg support section and the back rest are pivotally secured to the seat section to extend from the seat section at desired angles in relation to the plane of said seat section to provide a chair structure or table structure. The patient support structure may further comprise one or more actuators to adjust the angle of extension of the backrest and leg support section in relation to the plane of the seat section.

The base may ride on a plurality of caster assemblies, and the lift mechanism may allow the seat section to be lowered to a height of about 19 inches from the floor. The lift mechanism may be a scissor lift mechanism. The back rest may be radiolucent and may further comprise a first back section pivotally secured to the seat section, and a second back section hingedly attached to the first back section, and wherein the second back section is movable between a first position substantially parallel and on plane with the first backrest section, and a second rotated position placing the second backrest section in a position behind and substantially parallel to the first backrest section. When the back rest comprises a first and a second section, the back rest may further comprise a first locking mechanism for securing the second backrest section in the on plane position, and a second locking mechanism for securing the second backrest section in the rotated position.

The chair may further comprise opposed side armrest assemblies that can be moved from a locked support position to a folded and fully retracted horizontal storage position in the seat section. The chair may also further comprise a swivel assembly connecting the seat section and the scissor lift mechanism for rotation of seat section about its vertical axis on scissor lift mechanism.

The chair may further comprise one or more limit switches to define the state of orientation of the chair. The one or more limit switches may comprise a limit switch for signaling that the chair is in a forward facing, 0° position with respect to the base and a limit switch for signaling if the chair is secured in one of the rotation positions at 0°, 90° left, or at 90° right with respect to the base.

In another aspect, the present disclosure provides a low clearance mobile medical chair comprising a base that rides on a plurality of caster assemblies, a patient support structure, a lift mechanism extending upwardly from the base and coupling the base to the patient support structure, and opposed side armrest assemblies that can be moved from a locked support position to a folded and fully retracted horizontal storage position in the seat section. The lift mechanism comprises a lift actuator that functions to adjust the height of the patient support structure.

The patient support structure comprises a seat section, a back rest, and a leg support section. The leg support section and the back rest are pivotally secured to the seat section to extend from the seat section at desired angles in relation to the plane of said seat section to provide a chair structure or table structure.

The lift mechanism may allow the seat section to be lowered to a height of about 19 inches from the floor. The back rest may further comprise a first back section pivotally secured to the seat section, and a second back section hingedly attached to the first back section, wherein the second back section is movable between a first position substantially parallel and on plane with the first backrest section, and a second rotated position placing the second backrest section in a position behind and substantially parallel to the first backrest section. The back rest may further comprise a first locking mechanism for securing the second backrest section in the on plane position, and a second locking mechanism for securing the second backrest section in the rotated position.

The chair may further comprise a swivel assembly connecting the seat section and the scissor lift mechanism for rotation of seat section about its vertical axis on scissor lift mechanism. The chair may further comprise one or more limit switches to define the state of orientation of the chair. The one or more limit switches may comprise a limit switch for signaling that the chair is in a forward facing, 0° position with respect to the base and a limit switch for signaling if the chair is secured in one of the rotation positions at 0°, 90° left, or at 90° right with respect to the base.

In yet another aspect, the present disclosure provides a low clearance mobile medical chair comprising a base that rides on a plurality of caster assemblies, a patient support structure, and a lift mechanism extending upwardly from the base and coupling the base to the patient support structure, a swivel assembly connecting the seat section and the lift mechanism for rotation of seat section about its vertical axis on lift mechanism, and opposed side armrest assemblies that can be moved from a locked support position to a folded and fully retracted horizontal storage position in the seat section. The lift mechanism comprises a lift actuator that functions to adjust the height of the patient support structure.

The patient support structure comprises a seat section, a back rest, and a leg support section. The leg support section and the back rest are pivotally secured to the seat section to extend from the seat section at desired angles in relation to the plane of said seat section to provide a chair structure or table structure.

The lift mechanism may allow the seat section to be lowered to a height of about 19 inches from the floor. The back rest may comprise a first back section pivotally secured to the seat section, and a second back section hingedly attached to the first back section, wherein the second back section is movable between a first position substantially parallel and on plane with the first backrest section, and a second rotated position placing the second backrest section in a position behind and substantially parallel to the first backrest section. The back rest may be radiolucent and may further comprises a first locking mechanism for securing the second backrest section in the on plane position, and a second locking mechanism for securing the second backrest section in the rotated position.

The chair may further comprise one or more limit switches to define the state of orientation of the chair. The one or more limit switches may comprise a limit switch for signaling that the chair is in a forward facing, 0° position with respect to the base and a limit switch for signaling if the chair is secured in one of the rotation positions at 0°, 90° left, or at 90° right with respect to the base.

BRIEF DESCRIPTION OF THE DRAWINGS

The following drawings form part of the present disclosure and are included to further demonstrate certain aspects of the present disclosure. The disclosure may be better understood by reference to one or more of these drawings in combination with the detailed description of specific aspects presented herein. The drawings are not to scale.

DETAILED DESCRIPTION

The present disclosure is directed to a multifunctional and adjustable mobile medical chair that is accessible to patients based on ADA recommendations, without compromising any functionality normally desirable in such medical equipment. For instance, a chair of the present disclosure is capable of swiveling about an axis and can be raised and lowered to heights required for use in medical procedures, thereby limiting the need to transfer a patient from the chair to perform the procedures. Other benefits of a medical chair of the present disclosure are described further below.

Figure 2:
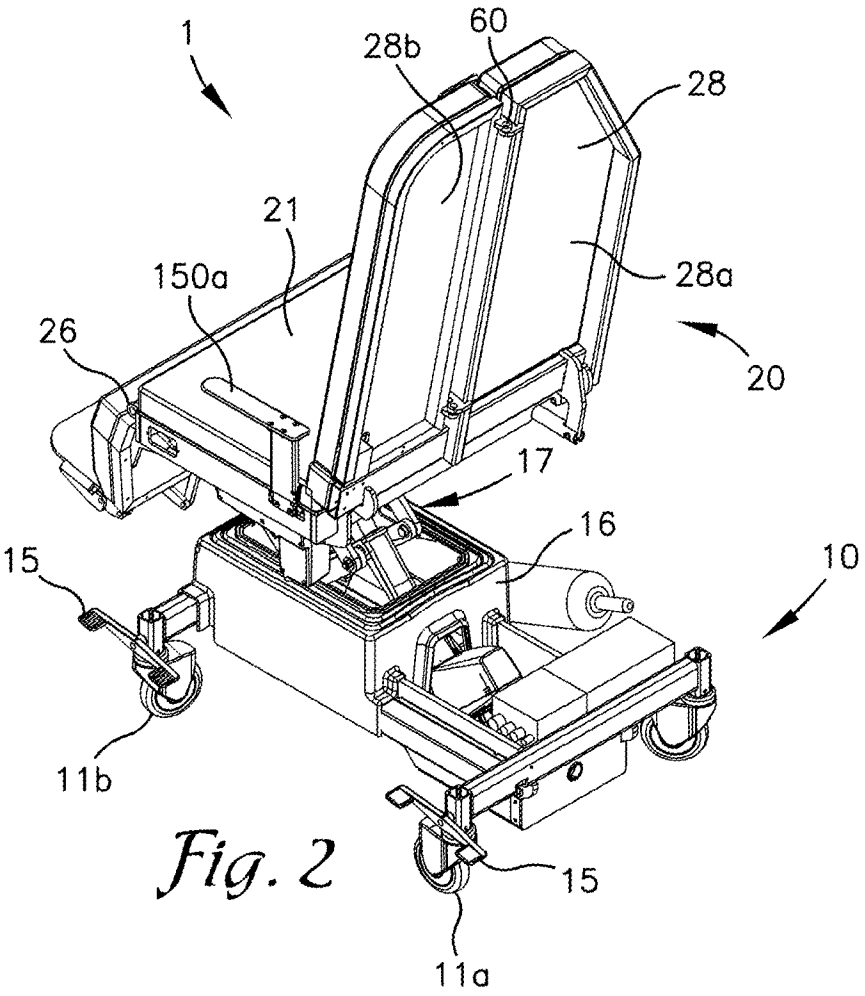
FIG. 2 depicts a back left side perspective view of an embodiment of the medical chair with covering attached to the base.
Figure 1:
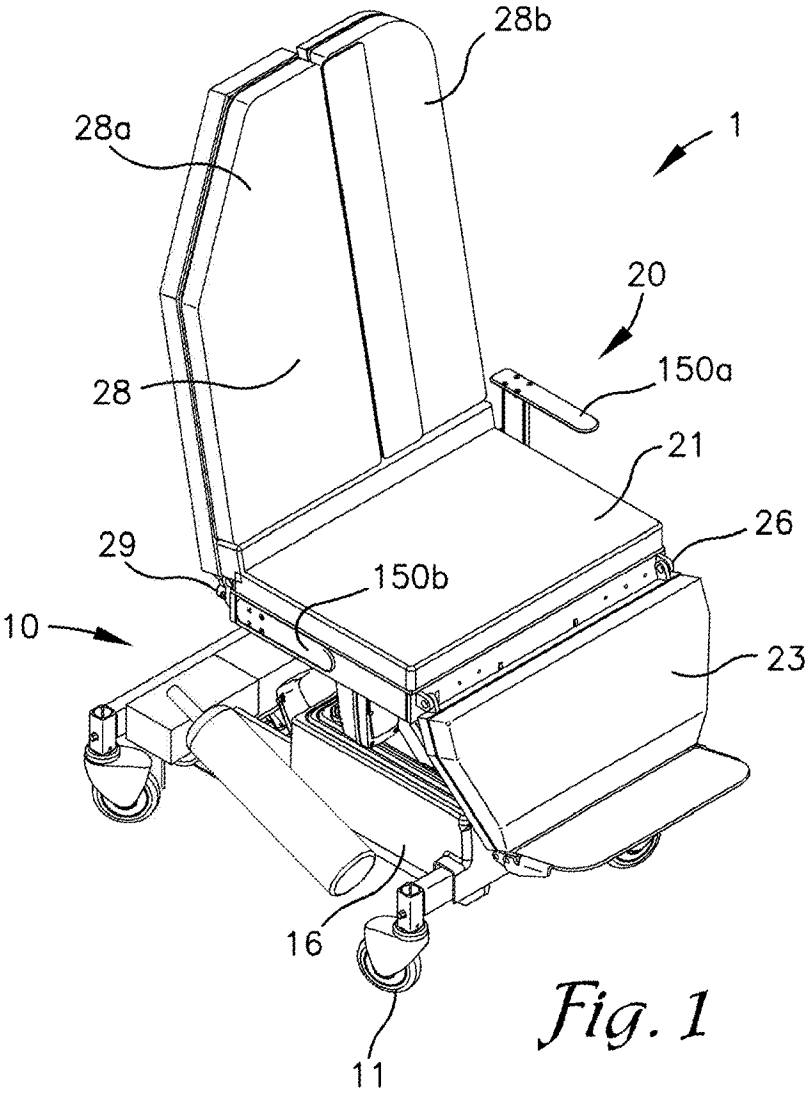
FIG. 1 depicts a front right side perspective view of an embodiment of the medical chair with covering attached to the base.
Figure 4:
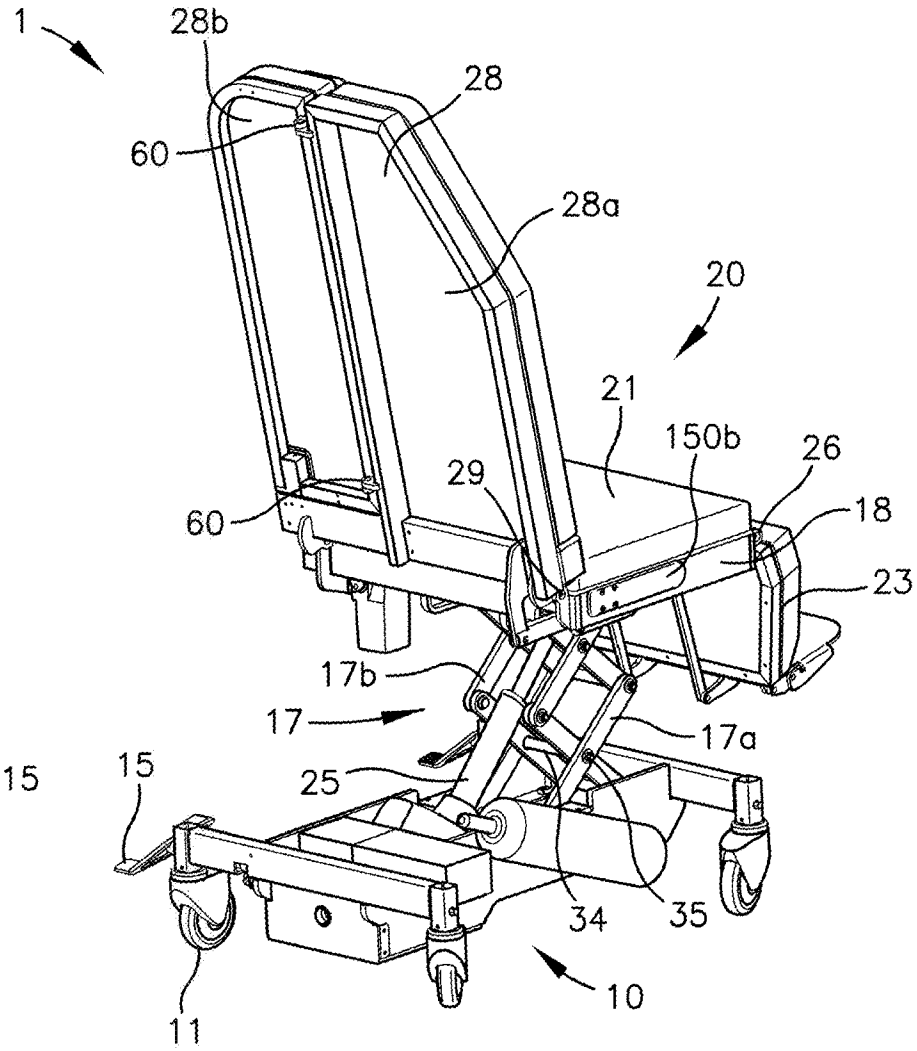
FIG. 4 depicts a back right side perspective view of an embodiment of the medical chair with covering removed.
Figure 3:
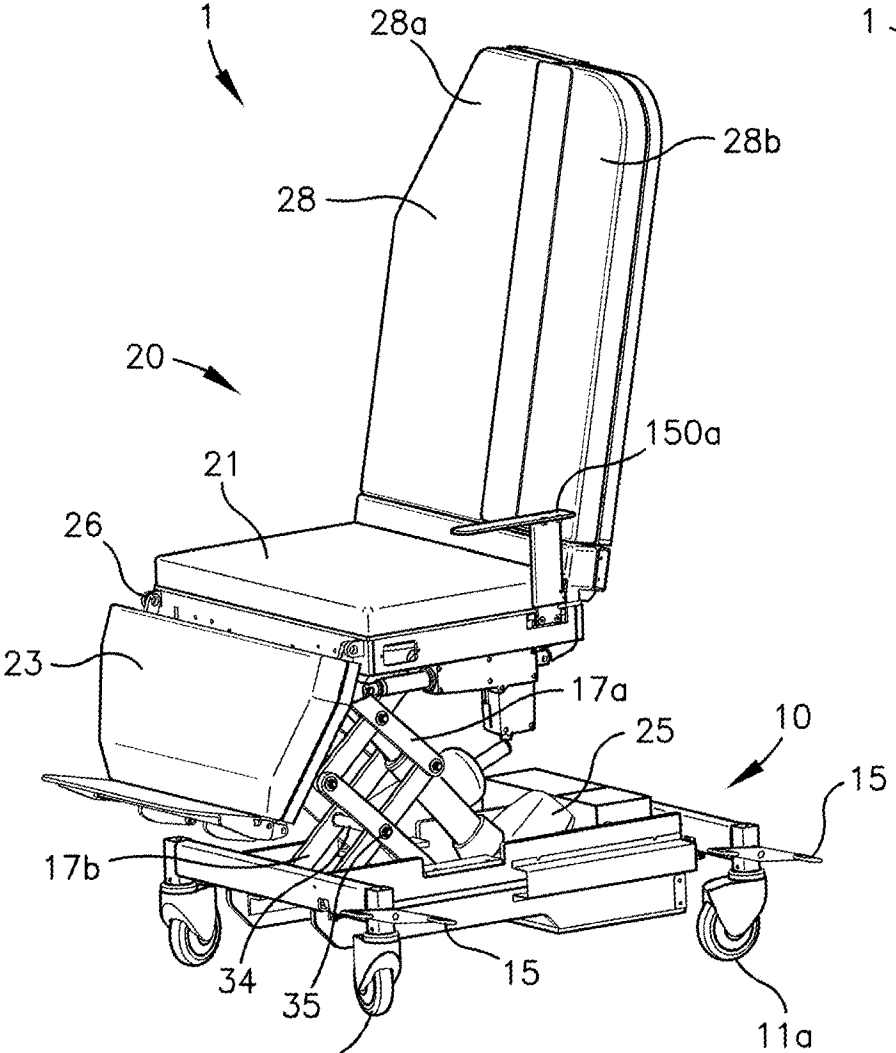
FIG. 3 depicts a front left side perspective view of an embodiment of the medical chair with covering removed.

Referring now to FIGS. 1-4, a medical chair in accordance with this invention is designated generally by the numeral 1. Base 10 provides support for medical chair 1 and rides on a plurality of caster assemblies 11 so that chair 1 is mobile. The caster assemblies can rotate 360°. One or more of the caster assemblies 11 may be equipped with a brake system 15 that selectively controls the ability of the caster assemblies 11 to lock when desired. Preferably, two of the four caster assemblies 11 of the base 10 are equipped with a brake system 15. Even more preferred, the two left caster assemblies 11*a* and 11*b* are equipped with brake systems 15 as shown in FIGS. 2 and 3. FIGS. 1 and 2 show the medical chair 1 with a shroud covering 16 attached to the base 10 of the chair 1, and FIGS. 3 and 4 show the medical chair 1 with the shroud covering 16 removed. The covering 16 covers and protects devices and mechanisms essential for operation of the chair 1 that will be discussed further below.

Figure 5:
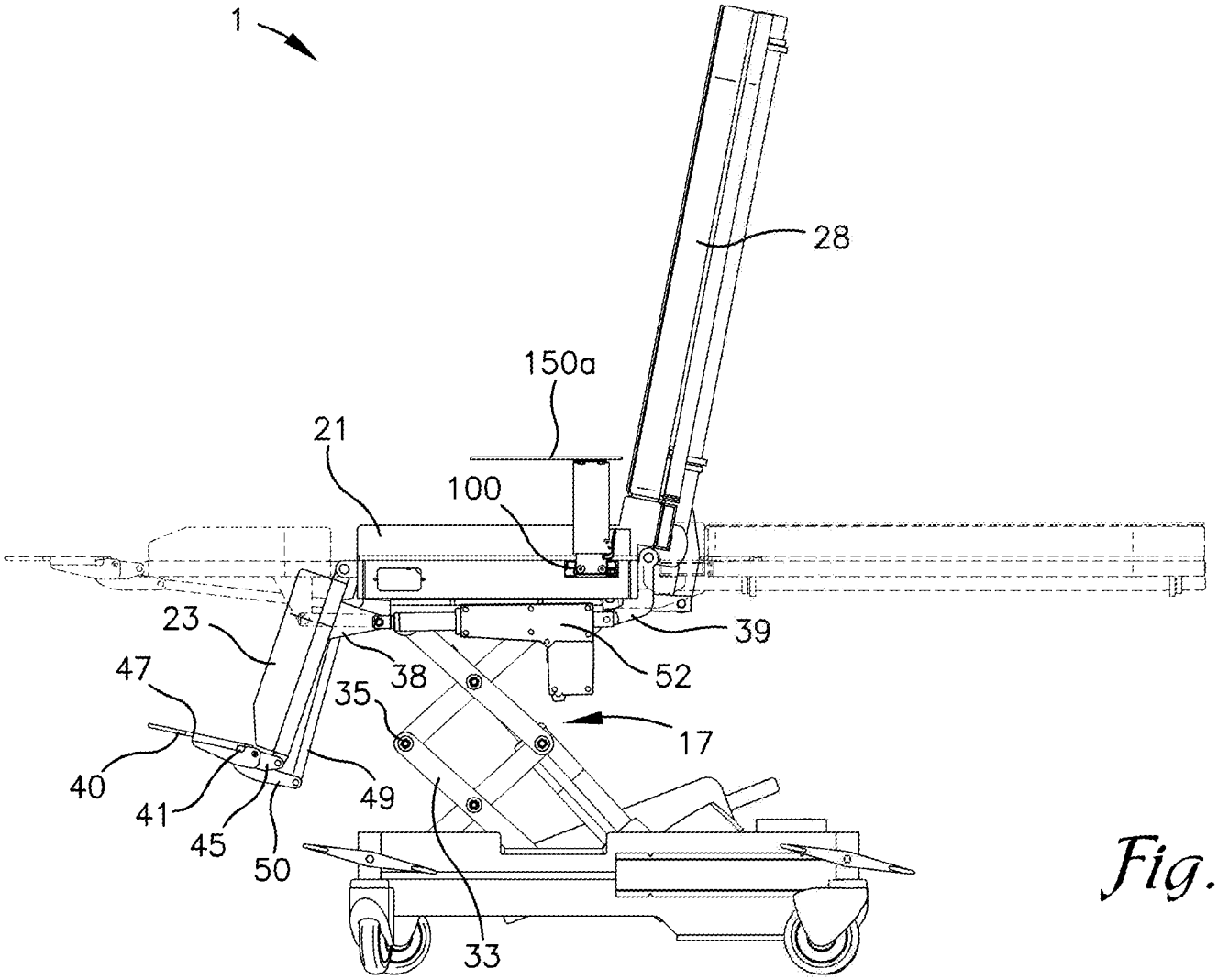
FIG. 5 is a side plan view showing the medical chair in a chair configuration and a table configuration, the table configuration being shown in phantom.
Figure 6:
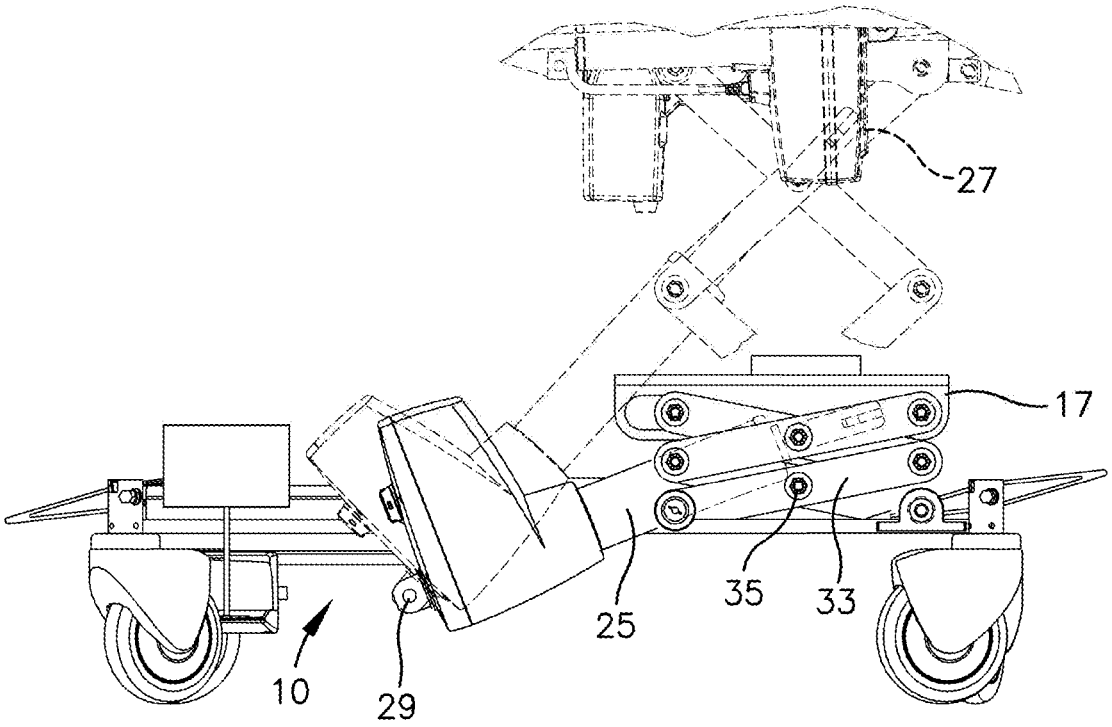
FIG. 6 depicts a detailed view of the scissor lift mechanism and the scissor lift actuator in the downward collapsed position and the upward position, the upward position being shown in phantom.

A chair of the present disclosure comprises a lift mechanism 17 extending upwardly from base 10 to couple the base 10 to a patient support structure generally designated by the numeral 20. Patient support structure 20 comprises seat section 21, leg support section 23, and back rest 28. Leg support section 23 is pivotally mounted to seat section 21 as at leg hinges 26, and back rest 28 is pivotally mounted to seat section 21 as at back hinges 29. Particularly, lift mechanism 17 supports seat section 21 in a position generally parallel to the ground, and leg support section 23 and back rest 28 may be positioned to provide a chair structure or table structure or any compromise between these positions, as is generally known. FIG. 5 shows the medical chair 1 in a chair configuration and a table configuration.

Any lift mechanism may be used to couple the base 10 to the patient support structure 20, provided the lift mechanism is capable of lowering the seat section 21 of the medical chair 1 to a height of about 19 inches from the floor in compliance with the specifications set forth by the Americans with Disabilities Act (ADA) without compromising any functionality normally desirable in such medical equipment, including the ability to swivel about an axis and the ability to be raised and lowered to required heights. Preferably, the lift mechanism is a scissor lift mechanism.

Figure 8:
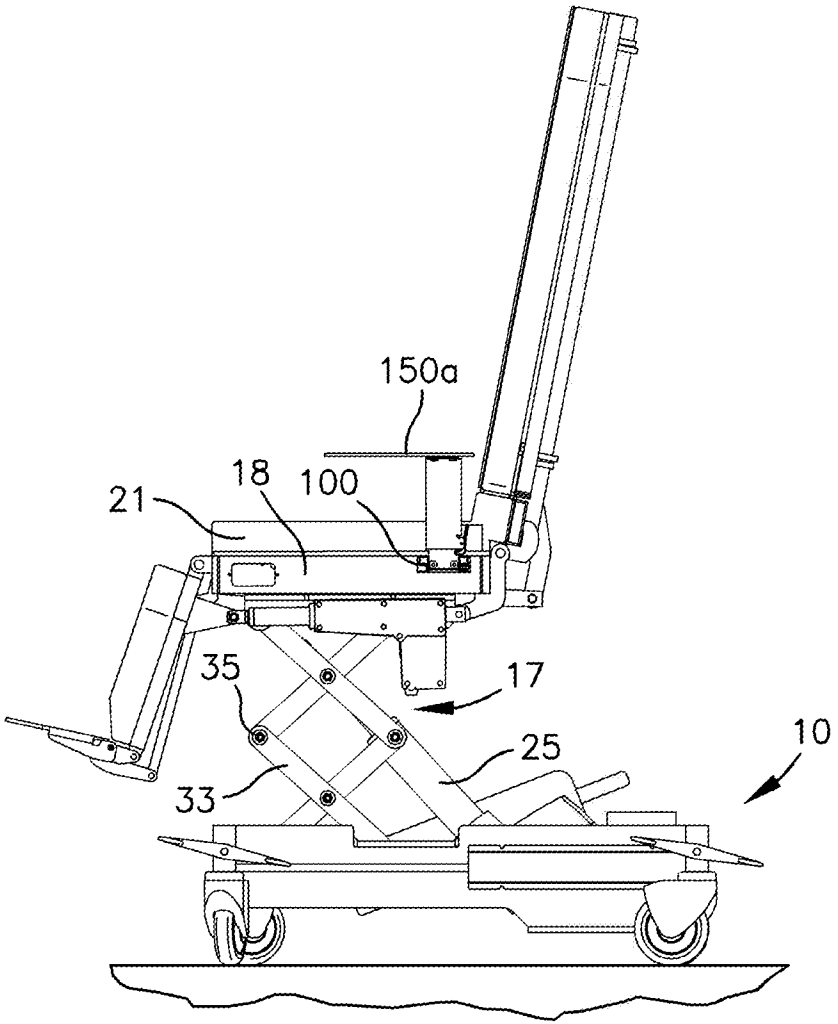
FIG. 8 depicts a left side view of the medical chair in the raised position.
Figure 7:
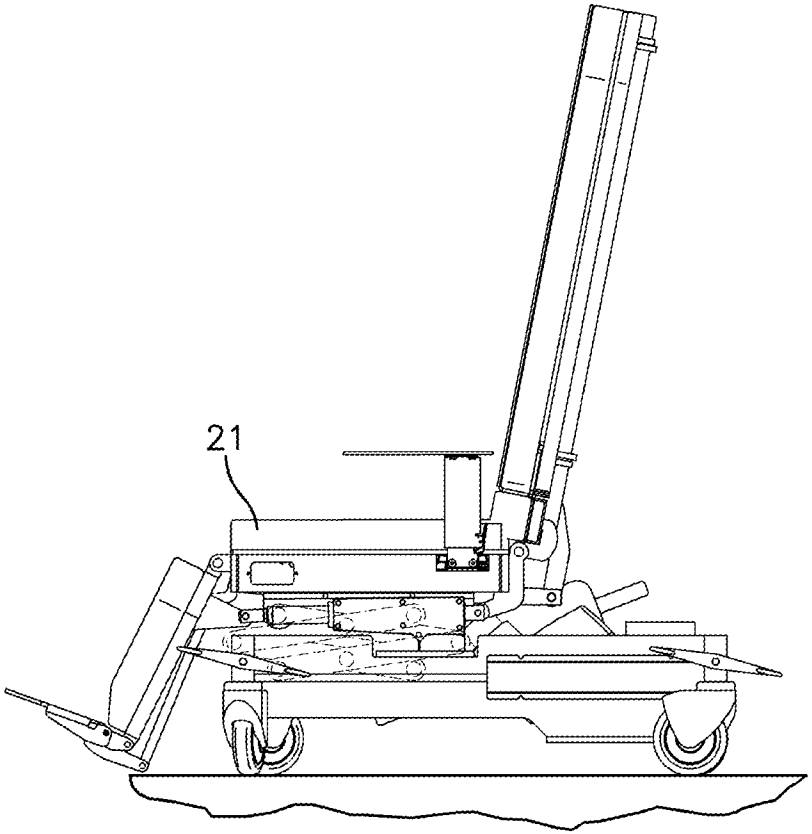
FIG. 7 depicts a left side view of the medical chair in the lowered position.

Referring now to FIGS. 3-8, an embodiment of the chair wherein the lift mechanism 17 is a scissor lift mechanism is shown. The scissor lift mechanism 17 can be seen in a downward collapsed position and upward extended position. The scissor lift mechanism 17 is moved upward and downward by lift actuator 25. The lift actuator 25 functions to adjust the height of the patient support structure 20 in relation to the floor. When the lift mechanism is a scissor lift mechanism, the scissor lift mechanism 17 is preferably a twin scissor mechanism comprising two scissor arms 17*a* and 17*b*, with lift actuator 25 interposed between the scissor arms 17*a* and 17*b*, although other methods of positioning the lift actuator 25 in relation to the scissor lift mechanism 17 can be envisioned. Each scissor arm comprises a plurality of pivotally joined scissor linkages 33. Preferably, each scissor arm 17*a*, 17*b* comprises four (4) pivotally joined scissor linkages 33. The scissor arms are further connected to each other by linkers 34 connecting center pivots 35 of scissor arms. Lift actuator 25 is hingedly attached to the underside of seat section 21 as at seat hinges 27 (shown in FIG. 6 only), and to base 10 as at base hinges 29 (shown in FIG. 6 only), such that the angle of the actuator 25 relative to the base 10 and the seat section 21 changes as the seat section 21 is raised or lowered as shown in FIGS. 7 and 8.

Actuator 25 and other actuators described further below generally are screw type actuators, wherein a screw is rotated by means of a motor to advance or retract the screw, thus regulating the angle or height of a section attached to the actuator. Other mechanisms may also be envisioned.

The chair may further comprise one or more actuators to adjust the angle of extension of leg support section 23 and back rest 28 in relation to the plane of seat section 21. For instance, a chair of the invention may comprise a single actuator to simultaneously adjust the angle of extension of leg support section 23 and back rest 28 in relation to the plane of seat section 21. Alternatively, the chair may comprise a first actuator to adjust the angle of extension of leg support section 23, and a second actuator to adjust the angle of extension of back rest 28 in relation to the plane of seat section 21, thereby allowing the extension of leg support section 23 and the back rest 28 independently from each other.

Figure 9:
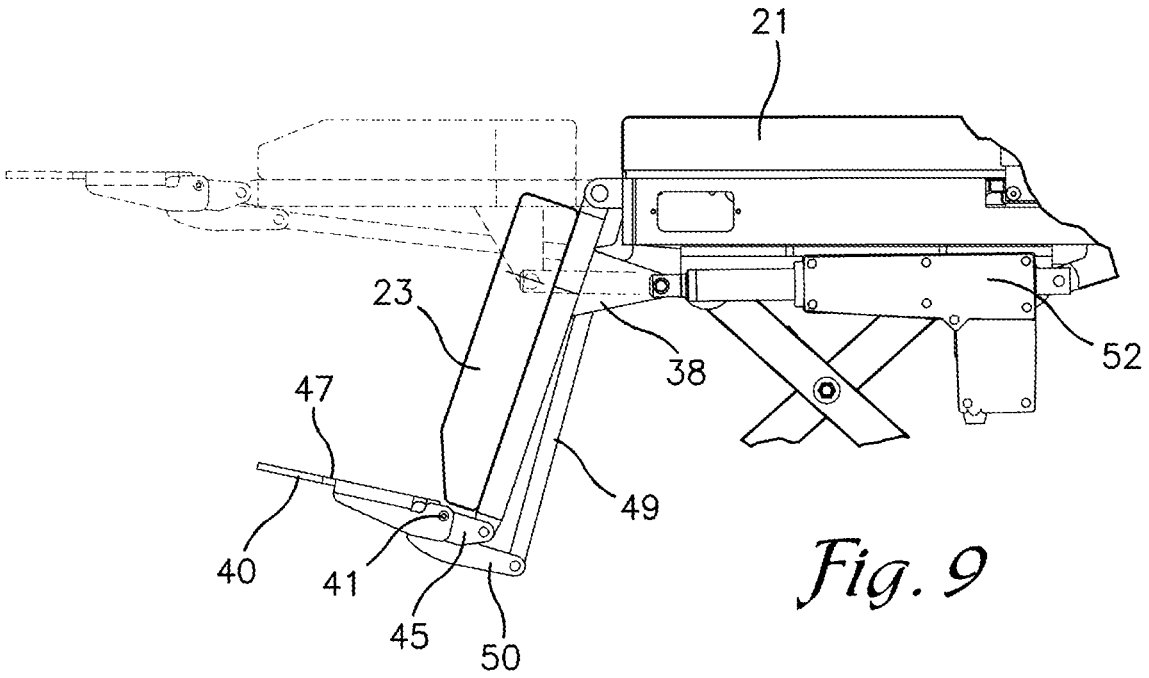
FIG. 9 depicts a detailed view of the general configuration of the leg support and leg support actuator showing the position of the leg support when the medical chair is in a chair configuration and a table configuration, the table configuration being shown in phantom.

Referring now to FIGS. 5 and 9, an embodiment of the chair is shown, wherein the chair comprises a first actuator to adjust the angle of extension of leg support section 23, and a second actuator to adjust the angle of extension of back rest 28 in relation to the plane of seat section 21. As such, in this embodiment, the angles of extension of leg support section 23, and back rest 28 in relation to the plane of seat section 21 can be adjusted independently using the actuators. Leg support actuator 52 is fixedly mounted to the underside of seat section 21, and pivotally communicates with leg support section 23 through mounting bracket 38. Leg support actuator 52 regulates the angle at which leg support section 23 extends from seat section 21 by advancing and retracting the screw of leg support actuator 52. The angle of extension of the leg support section 23 may range from largely perpendicular to the plane of seat section 21 in a chair configuration of the medical chair 1 to substantially parallel to the plane of seat section 21 in a table configuration of the medical chair 1 (drawn in phantom in FIGS. 5 and 9). The term "largely perpendicular" may be used to refer to any angle of extension of the leg support section 23 to the plane of seat section 21 in a chair configuration that is sufficient to provide easy access for a patient to get into and out of the medical chair, and to provide sufficient clearance for mechanical and electronic components under the seat section 21 and on the base 10. Preferably, the angle of extension of the leg support section 23 in a chair configuration is about 10° to 20° from perpendicular to the plane of seat section 21, preferably 15°.

Footrest 40 is pivotally secured to leg support section 23. Footrest 40 provides a footrest surface 47 substantially perpendicular to leg support section 23 when the patient support structure 20 is in a chair configuration. As leg support section 23 is moved from the chair structure position to the table structure position, the footrest 40 pivots to provide a footrest surface 47 substantially parallel and on plane with leg support section 23 and seat section 21 when the patient support structure 20 is in a table configuration. This may be accomplished by pivotally securing at least one footrest link 49 connecting seat section 21 and footrest bracket 50. Other mechanisms for the functioning of the foot surface are also envisioned.

In some embodiments, foot rest 40 can also be rotated about pivot pin 41 at mounting bracket 45 to place foot surface 47 in an upward position generally parallel to leg support section 21 where the foot rest 40 will not interfere with the user's ability to get into and out of the wheelchair, or generally perpendicular to the plane of seat section 21 to provide foot support during transfer of a user. In some alternatives of the embodiments, a locking mechanism may be provided to lock the foot rest 40 in an upward position. Generally, the foot rest 40 is operated manually.

Figure 10:
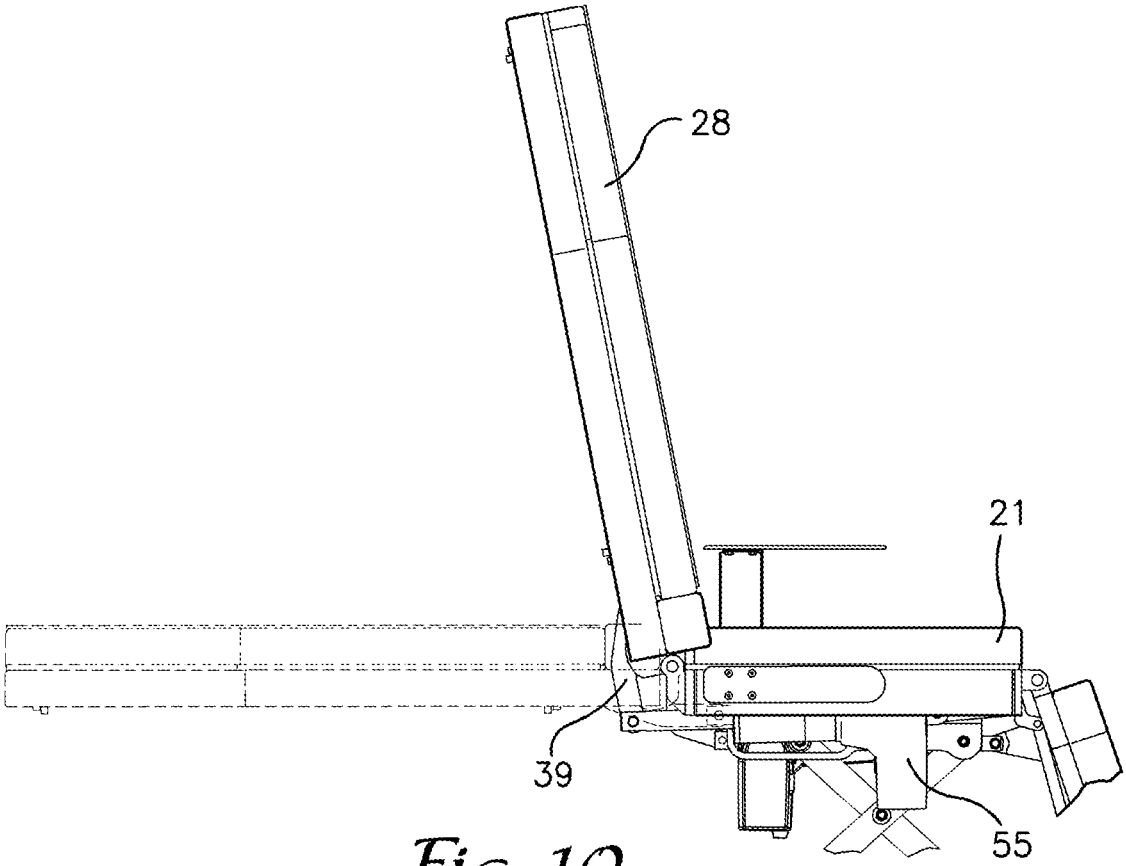
FIG. 10 depicts a detailed view of the general configuration of the backrest and backrest actuator showing the position of the backrest when the medical chair is in a chair configuration and a table configuration, the table configuration being shown in phantom.

Referring now to FIGS. 5 and 10, backrest actuator 55 functions to adjust the angle of extension of back rest 28 in relation to the plane of seat section 21. The angle of extension of the back rest 28 may range from generally perpendicular to the plane of seat section 21 in a chair configuration of the medical chair 1 to substantially parallel to the plane of seat section 21 in a table configuration of the medical chair 1 (drawn in phantom in FIGS. 5 and 10). Backrest actuator 55 is fixedly mounted to the underside of seat section 21, and pivotally communicates with backrest 28 through mounting bracket 39.

In some embodiments, backrest 28 is substantially the same width as seat section 21. It is sometimes advantageous to provide a narrower back rest to accommodate narrower bays in some radiographic and fluoroscopic devices. As such, in some embodiments, a medical chair of the invention may be provided with a narrower backrest 28. In other embodiments, a narrower backrest may be provided by backrest 28 comprising two sections, section 28*a* and section 28*b* wherein section 28*a* is pivotally mounted to seat section 21 as described for backrest 28 above, and section 28*b* is removably and pivotally mounted to seat section 21. In yet other embodiments, a narrower backrest may be provided by backrest 28 comprising two sections, section 28*a* and section 28*b* wherein section 28*a* is pivotally mounted to seat section 21 as described for backrest 28 above, and section 28*b* is removably mounted to backrest section 28*a*. In such embodiments, backrest section 28*b* may be normally attached to the medical chair and can be pivoted with backrest 28*a* to the chair and table position, but can be removed to accommodate the narrower bays of radiographic and fluoroscopic devices.

Figure 12:
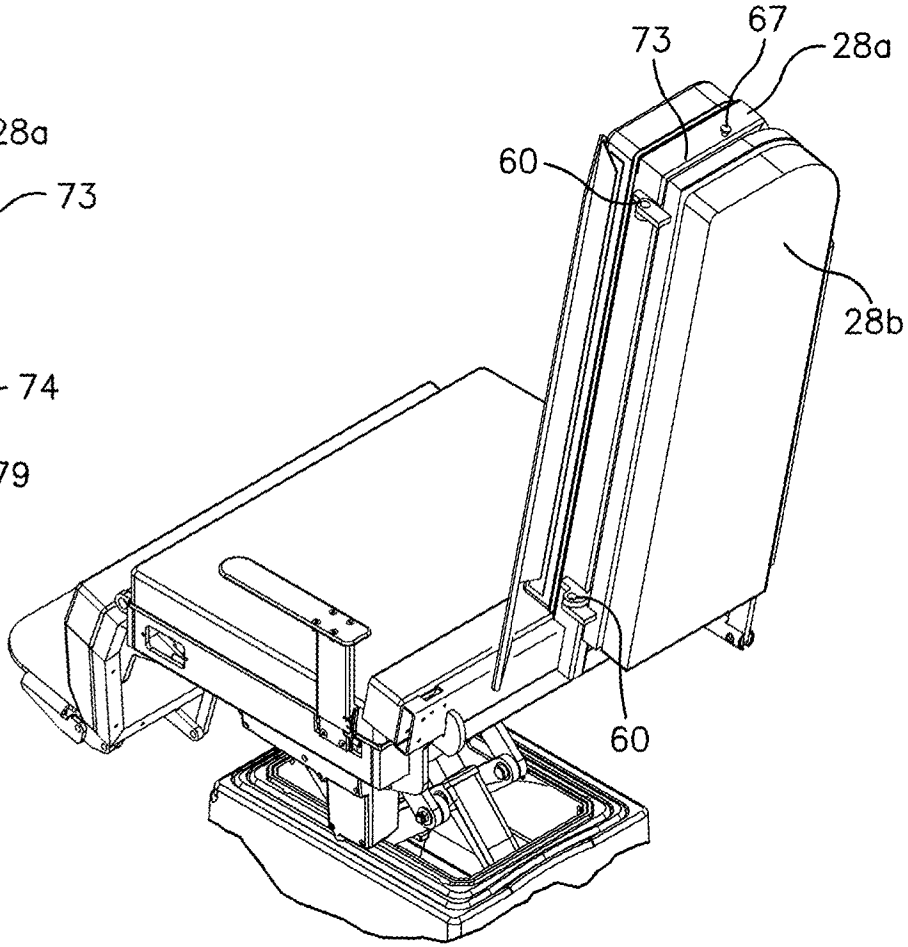
FIG. 12 depicts a rear perspective view of the backrest showing an embodiment when the backrest comprises a first and a second section wherein the second section is hingedly attached to the first section, when the second backrest section is rotated to the rear of the chair and behind the first backrest section.
Figure 13:
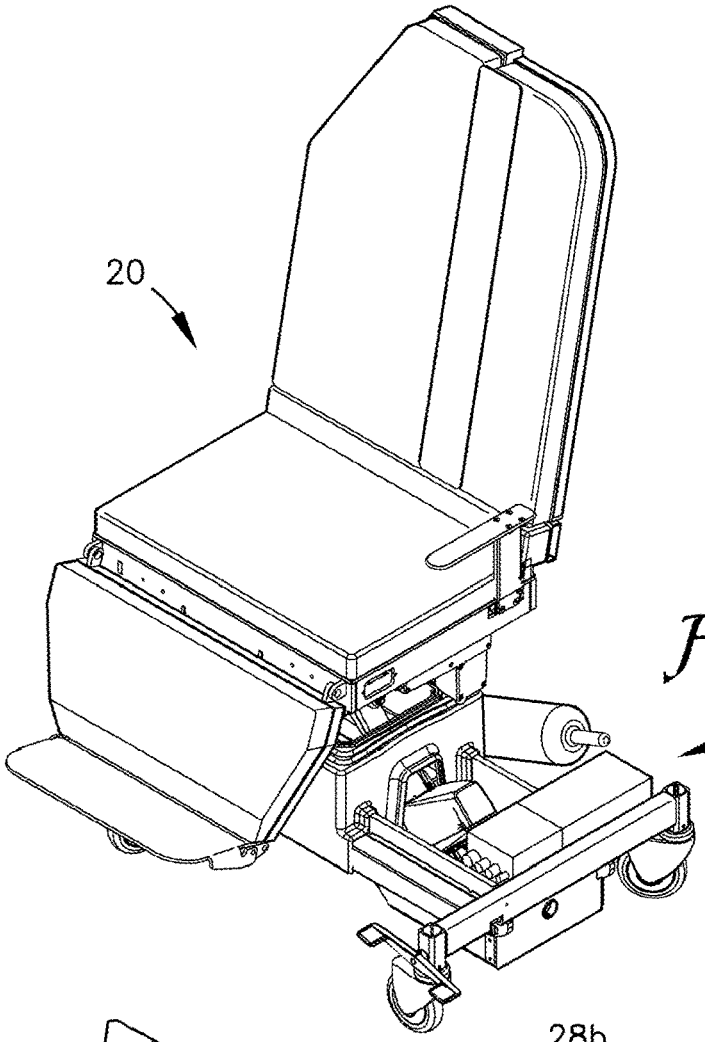
FIG. 13 depicts a perspective top front view of the medical chair when the patient support structure is rotated 90 degrees as compared to the position of seat section.

In preferred embodiments, backrest 28 comprises two sections, section 28*a* and section 28*b* wherein section 28*a* is pivotally mounted to seat section 21 as described for backrest 28 above, and section 28*b* is hingedly attached to backrest section 28*b* on hinges 60 as shown in FIGS. 2, 4, 11, and 12. In these embodiments, backrest section 28*b* is movable between a first position in which backrest section 28*b* is substantially parallel and on plane with backrest section 28*a* as shown in FIGS. 1-4, 12, and 15, and a second position in which backrest section 28*b* is rotated to the rear of the chair to place the backrest section 28*b* in a position behind backrest section 28*a* substantially parallel to backrest section 28*a* as shown in FIG. 13.

Figure 11:
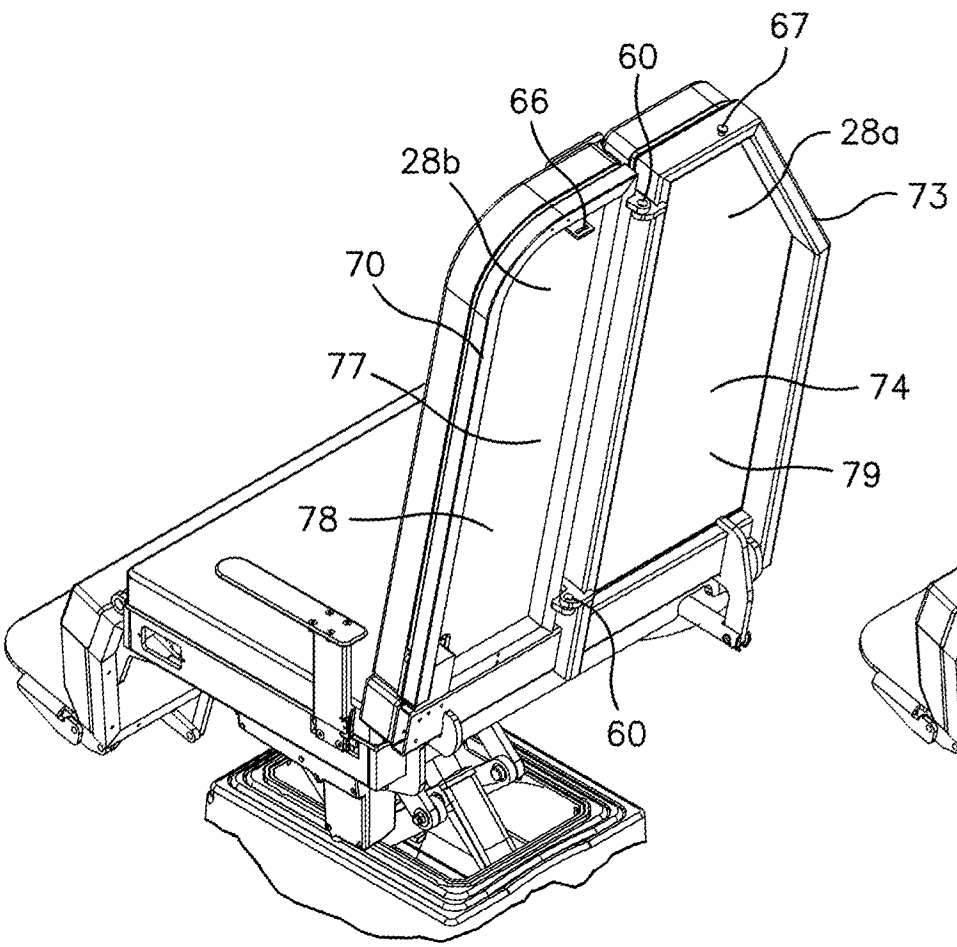
FIG. 11 depicts a rear perspective view of the backrest showing an embodiment when the backrest comprises a first and a second section wherein the second section is hingedly attached to the first section, when the first and second sections are in the same plane.
Figure 14:
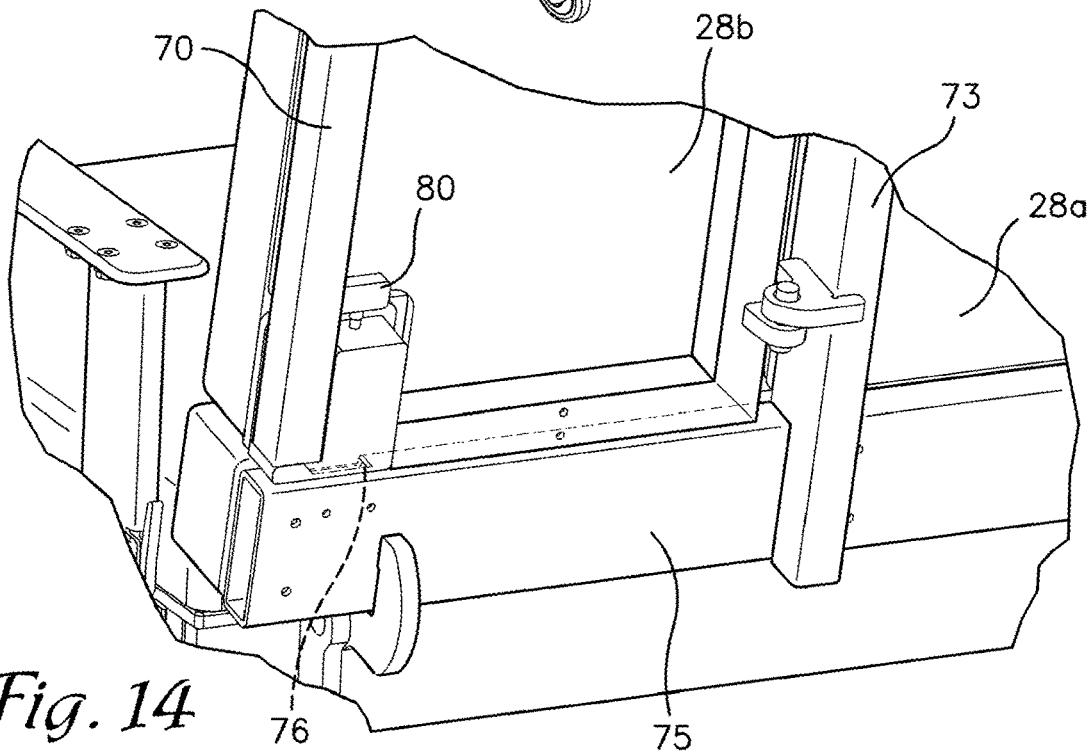
FIG. 14 depicts a detailed view of a locking mechanism for locking a second section of the backrest.

One or more locking mechanisms may be used to secure the backrest section 28*b* in the on plane position and in the rotated position. Locking mechanisms are known in the art and include latch mechanisms, locking roller mechanisms, and locking plunger mechanisms. Some embodiments of such locking mechanisms for securing the backrest section 28*b* in the on plane position and in the rotated position are shown in FIGS. 11, 12 and 14. In these embodiments, locking mechanisms comprise a first locking mechanism for securing the backrest section 28*b* in the on plane position, and a second locking mechanism for securing the backrest section 28*b* in the rotated position.

FIGS. 11 and 12 show an embodiment of a first locking mechanism for locking backrest section 28*b* in the rotated position. In this embodiment, the locking mechanism comprises a notch member 66 fixedly attached on frame 70 of backrest section 28*b* and locking plunger 67 on frame 73 of backrest section 28*a* as shown in FIG. 11. FIG. 12 shows backrest section 28*b* in the rotated position, and locking plunger 67 engaging notch member 66 (not shown), and securing the backrest section 28*b* to the backrest section 28*a* in the rotated position.

FIG. 14 shows an embodiment of a second locking mechanism for locking backrest section 28*b* in the on plane position. In this embodiment, the locking mechanism comprises a notch 76 in backrest frame member 75 of backrest section 28*a* and locking plunger 80 on frame 70 of backrest section 28*b*. In FIG. 14 backrest section 28*b* is shown in the on plane position with locking plunger 80 engaging notch 76, and securing the backrest section 28*b* to the backrest section 28*a* in the on plane position. FIG. 14 shows backrest section 28*b* in the on plane position, and locking plunger 80 on frame 70 of the back of backrest section 28*b* engaging backrest frame section 75 to secure the backrest section 28*b* to the backrest frame member 75 of backrest section 28*a* in the on plane position.

Backrests in accordance with this invention, whether full, narrow, or comprised of two sections preferably provide a radiolucent window. With radiolucent backrests, radiographic or fluoroscopic procedures of the upper body of a patient may be carried out to view medical conditions relating to the patient. Thus, in particularly preferred embodiments, backrest section 28*a* is substantially defined by frame member 73, and backrest section 28*b* is substantially defined by frame member 70 each providing a radiolucent window 74 and 77, respectively, devoid of any material that would compromise the radiolucent property of the backrest. As such, the backboards 78 and 79 of backrest sections 28*a* and 28*b* are generally formed from radiolucent materials. Suitable radiolucent materials are known in the art and may include without limitation, phenolic materials, lexane materials, and carbon fiber materials.

Push bars (not shown) may be provided on the back of backrest 28 to allow an attendant to maneuver chair 1. Any configuration of a push bar may be used, provided the push bar does not interfere with the disclosed functions of the chair, including the split back and the radiolucent back.

Preferred embodiments of medical chair 1 further include opposed side armrest assemblies 150*a* and 150*b* that can be moved from a locked support position, as shown in FIGS. 2 and 3 for arm rest assembly 150*a*, to a folded and tucked horizontal storage position in seat section 21 through a notch 100 in side 18 of seat section 21, as shown in FIGS. 1, 4, 10, 15, and 17 for arm rest assembly 150*b*. Alternatively, the side armrest assemblies may be folded and tucked under seat section 21. In preferred embodiments, armrests can be fully retracted against the side 18 of the seat section 21 to remove the arm as an obstruction with respect to imaging and to prevent interference with the structure below the seat at the lowest heights.

Figure 15:
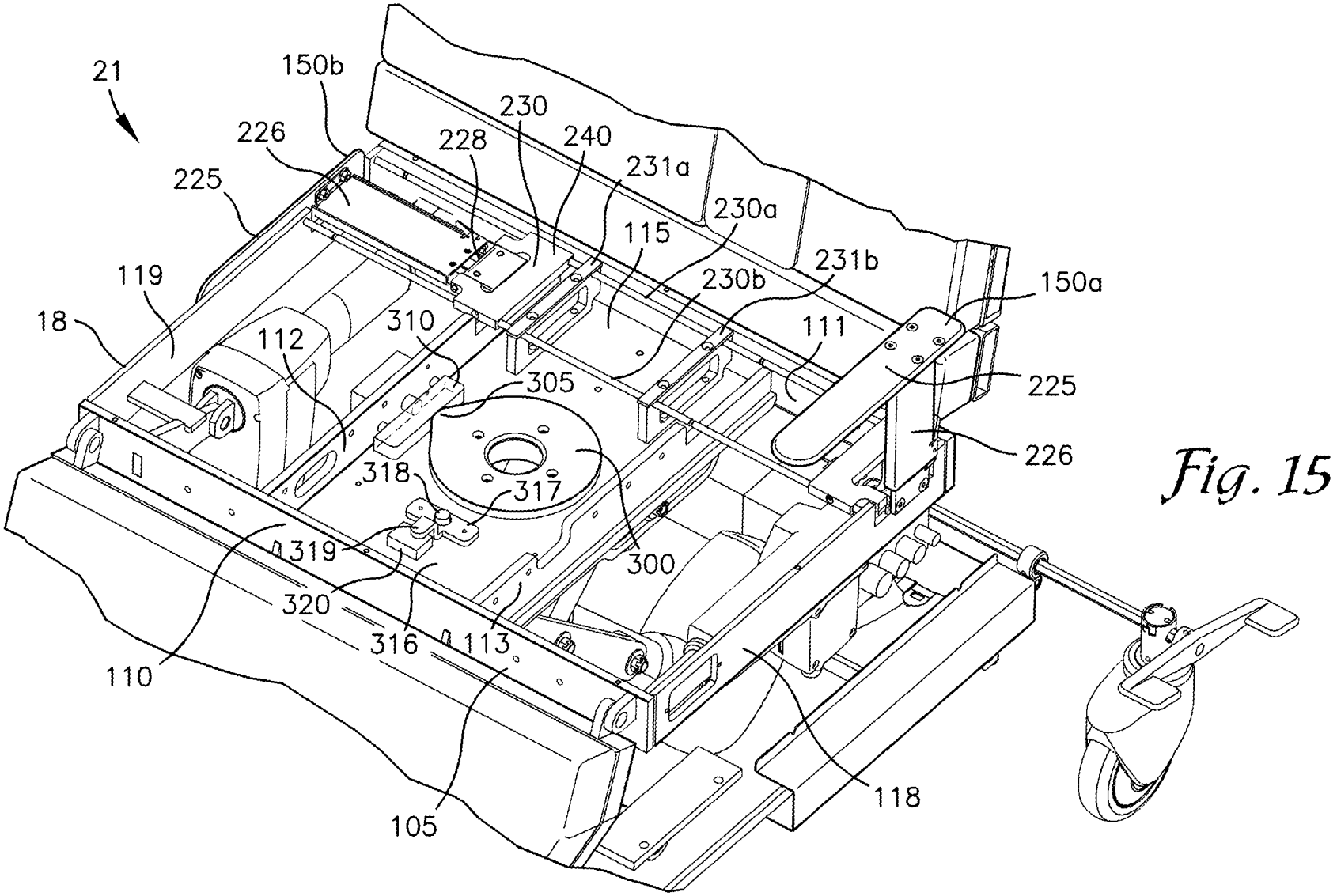
FIG. 15 depicts a detailed view of the seat section with the seating cushion removed to show the frame of the seat section, the arm rest rails and arm rests, the equipment utilized in detecting the orientation of the chair both with respect to its rotation about its vertical axis and with respect to the vertical position of the chair.

Any mechanism or collection of mechanisms for providing armrest assemblies for folding and tucking arm rests into a horizontal storage position in seat section 21 may be used. FIG. 15 provides one such embodiment, wherein an armrest 150*a* or 150*b* can be fully retracted against the side 18 of the seat section 21 and tucked in seat section 21. FIG. 15 shows the frame 105 of seat section 21 when the padding is removed. Frame 105 is comprised of front and rear frame members 110 and 111, left and right frame members 118 and 119, and center frame members 112 and 113. Extending across the center of frame 105 between center members 112 and 113, from front to rear, is rotating plate 115, attached to rear frame piece 111 and to front frame piece 110, and to center members 112 and 113, from front to rear is rotating plate 115. In the embodiment shown in FIG. 15, the arm rest comprises an arm rest section 225 fixedly connected at a right angle to an upright section 226. Upright section 226 comprises a locking mechanism (not shown) for securing the arm rest to the side 18 of seat section 21 when the armrest 150 is in the upright position. Upright section 226 is hingedly attached to a sliding mechanism 230 secured to side frame elements 118 and 119 and to rotating plate 115 through brackets 231*a* and 231*b* of chair section 21. The sliding mechanism 230 comprises rails 230*a* and 230*b*, and rail-riding element 240 to guide the sliding motion of the armrests 150*a*, 150*b* on rails 230*a* and 230*b* into and out of the seat section 21. For tucking an armrest into seat section 21, upright section 226 is unlocked from the side 18 of seat section 21, rotated about hinge 228 to a position parallel to seat section 21, and slid into the seat section 21 on the sliding mechanism 230. Locking mechanisms for securing the armrests 150*a*, 150*b* to the seat section 21 in the tucked position may or may not be provided. Other mechanisms for slidably connecting the arm rests to the chair may also be envisioned.

Figure 16:
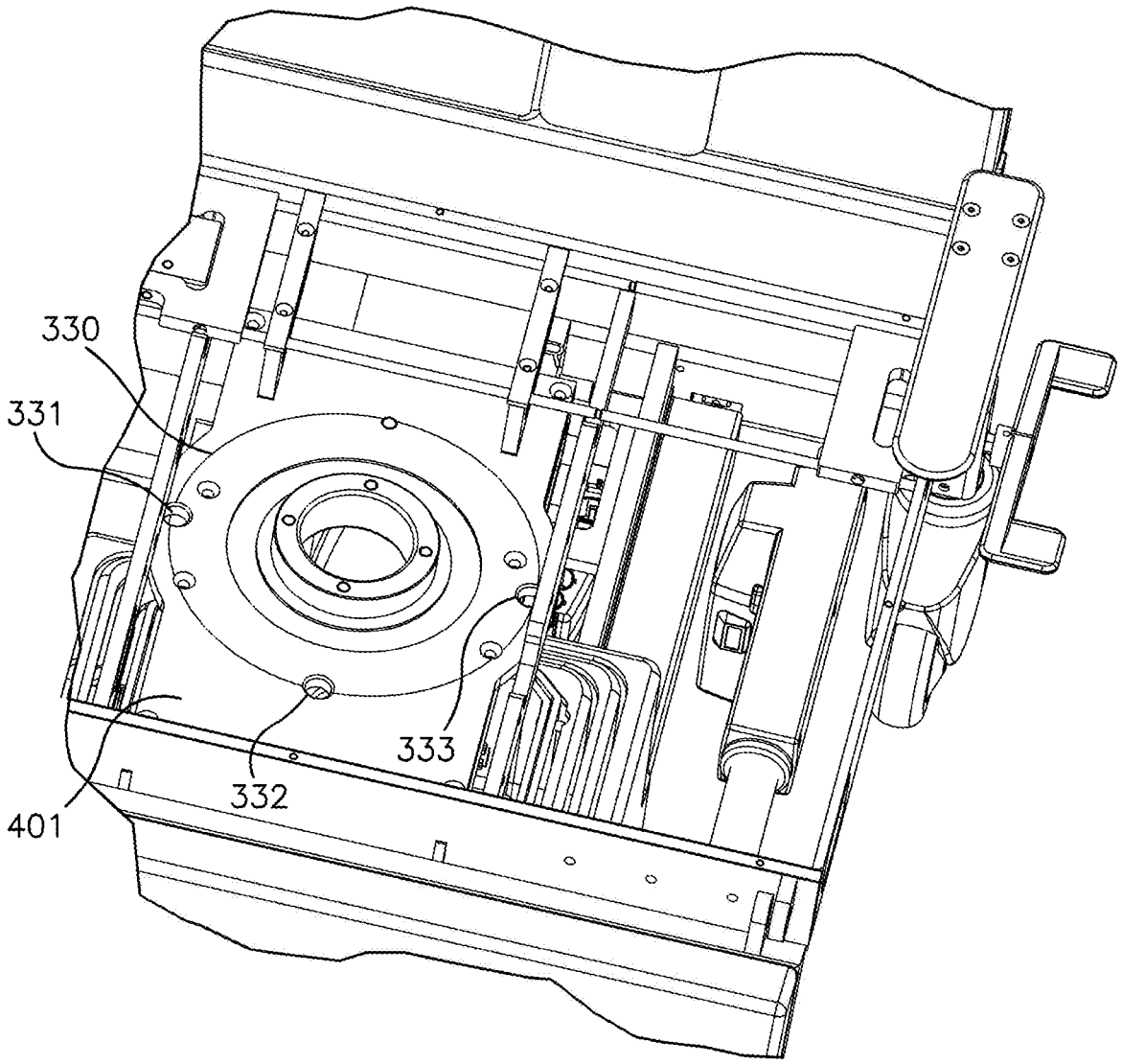
FIG. 16 depicts a detailed view of the stationary plate attached to the top of the scissor lift mechanism showing the circular path of the pin, and notches along the circular path for engaging the pin and securing the patient support structure in one of three positions at 0°, 90° left, or at 90° right with respect to the base.

The patient support structure 20 of the medical chair 1 can be rotated by about 90° to the left or to the right relative to the base 10 to facilitate positioning of the medical chair 1 in radiographic equipment and/or to facilitate patient access to the chair. This position is provided for use during some radiographic and fluoroscopic procedures when the length of the base 10 of the chair 1 prevents the chair from fitting in radiographic and fluoroscopic machines. To allow rotation of the patient support structure 20, the seat section 21 of the medical chair is fixed to the telescoping scissor lift mechanism 17 so as to pivot thereon using a swivel assembly (not shown). Swivel assemblies suitable for use in a medical chair of the present disclosure are commonly known in the art. FIGS. 15 and 16 show some components of the swivel assembly of the medical chair 1. The swivel assembly comprises a stationary plate 401, mounted on top of telescoping scissor lift mechanism 17 (not shown in FIGS. 15 and 16), and the rotating plate 115 mounted to seat frame members 112 and 113 through a swivel assembly (not shown). Rotating plate 115 and patient support structure 20 can thus rotate on stationary plate 401. In FIG. 13, the patient support structure 20 has been rotated 90° to the left on scissor lift mechanism 17, as compared to the forward-facing 0° position of the patient support structure 20 in FIGS. 1-7.

Now referring to FIGS. 15 and 16, the medical chair 1 further comprises one or more limit switches utilized to define the state of orientation of the chair 1. Height adjustment and positioning of the patient support structure 20 in a chair or table structure should be limited when the chair is rotated left/right in order to prevent tipping or damage to components of the medical chair 1. The one or more limit switches provide such a function by detecting and communicating the orientation of the patient support structure 20 with respect to its rotation about its vertical axis to provide safe operation of the medical chair 1. For instance, limit switches may communicate that the patient support structure 20 is not in the forward-facing 0° position or in one of the 90° rotated positions and may therefore not be safe for reclining or lowering the patient support structure 20.

FIGS. 15 and 16 show an embodiment of a first limit switch comprising a cam 300 and detector 310 assembly to detect and communicate if the patient support structure 20 is in the forward-facing 0° position. Cam 300 has a ridge or node 305 extending from the perimeter of cam 300. The cam 300 is placed above rotating plate 115 and is fixedly connected through an opening in rotating plate 115 to stationary plate 401 such that, when the patient support structure 20 is rotated about a vertical axis, the cam 300 remains stationary in relation to the rotating plate 115. Detector 310 is fixedly attached to frame member 112. Upon rotation of the patient support structure 20, node 305 will either contact and depress detector 310 rotating plate 115 as shown in FIG. 15, or node 305 will be released from contact with detector 310 (not shown). Detector 310 when depressed by node 305 signals that the chair is in the forward facing, 0° position with respect to the base 10.

FIGS. 15 and 16 also show an embodiment of a second limit switch generally designated by the numeral 316 to detect and communicate if the patient support structure 20 is secured in one of the rotation positions at 0° with respect to the base 10, at 90° left with respect to the base 10, or at 90° right with respect to the base 10. Limit switch 316 comprises a button 320 and a flange and pin assembly 317 comprising an S-shaped flange 315 fixedly attached to a pin 318. The button 320 and the flange and pin assembly 317 are supported by rotating plate 115 in a manner such that the lip 319 of flange 315 extends over button 320. Pin 318 of the flange and pin assembly 317 can be moved in a vertical direction and is biased downward by springs that apply a downward force. Pin 318 is in sliding contact with stationary plate 401 through an opening in rotating plate 115 such that, when the patient support structure 20 is rotated about a vertical axis, the pin 318 is pushed downward by the springs to remain in sliding contact along a 360° circular path 330 on stationary plate 401. Stationary plate 401 comprises notches 331, 332, and 333 offset at 90 degrees along the 360° circular path 330 such that notches 331, 332, and 333 limit the rotation of the patient support structure 20 by engaging pin 318 when the patient support structure 20 is in one of the rotation positions at 0°, 90° left, or at 90° right with respect to the base 10 thereby securing the patient support structure 20 in one of three positions. Pin 318 of the flange and pin assembly 317 is also attached at the top end of the pin 318 to a cable mechanism (not shown) to move the pin 318 in an upward direction to release the pin from one of the notches 331, 332, and 333 and allow the rotational repositioning of patient support structure 20. When pin 318 is engaged into one of the notches 331, 332, and 333, the lip 319 of flange 315 contacts and depresses button 320, signaling to a controller that the patient support structure 20 is secured in one of the rotation positions at 0°, 90° left, or at 90° right with respect to the base 10. Conversely, when pin 318 is not engaged in one of the notches 331, 332, and 333, the pin 318 and flange 315 are in an upward position, releasing button 320, and signaling to a controller that the patient support structure 20 is not secured in one of the rotation positions at 0°, 90° left, or at 90° right with respect to the base 10.

The first and second limit switches conspire to secure the patient support structure 20 in one of the rotation positions at 0°, 90° left, or at 90° right with respect to the base 10, and to signal to an operator the rotational position of the patient support structure 20 with respect to the base 10. As such, based on the rotational position of the seat, various position adjustment functions will be enabled or disabled as follows. All position adjustment functions are enabled when the patient support structure 20 is secured at 0° with respect to the base 10. Such a position is relayed when detector 310 is depressed by node 305 of cam 300, and when button 320 is depressed by flange 315 when pin 318 is engaged in one of the notches 331, 332, and 333.

When the patient support structure 20 is secured at 90° left, or at 90° right, the height of the patient support structure 20 may be moved up to the upper limit of travel, but can only be partially lowered to prevent components from contacting and damaging each other. Depending on the embodiment of the chair, the patient support structure 20 can be partially lowered to a height ranging from about 20 to about 30 inches from the floor, from about 25 to about 30 inches from the floor, preferably from about 27 to about 28 inches from the floor. Additionally, in some embodiments, when the patient support structure 20 is secured at 90° left, or at 90° right, only leg support section 23 can be moved to adjust the angle of extension of the leg support section 23 in relation to the plane of seat section 21. The position of backrest 28 in relation to the plane of seat section 21 is prevented from moving to the on plane position in relation to the plane of seat section 21 to prevent the chair from tipping under the weight of a patient seated in the chair when the patient support structure 20 is secured at 90° left, or at 90° right. Such a position is relayed when detector 310 is released by node 305 of cam 300, and when button 320 is depressed by flange 315 when pin 318 is engaged in one of the notches 331, 332, and 333.

All position adjustment functions are enabled when the seat is secured at 0° with respect to the base 10 to prevent tipping and damaging components. Such a position is relayed when detector 310 is released by node 305 of cam 300, and when button 320 is released by flange 315 when pin 318 is not engaged in one of the notches 331, 332, and 333.

A medical chair of the invention comprises electronic controls for up and down adjustments for backrest 28, leg support 23, and height of patient support structure 20 by controlling the various actuators described above. Controls may also be provided to automatically raise leg support section 23 and lower backrest 28 so as to advance sections of patient support structure 20 toward the table structure, or to advance both leg support section 23 and back support section 28 toward their respective chair structure positions. All position adjustment functions may be coordinated by a central electronic controller capable of receiving and interpreting signals from limit switches, and controlling or limiting the control of the actuators of the medical chair 1 based on the received signals. A tethered or wireless remote control 95 (shown in FIG. 17) may also be provided to operate the chair from a location remote from chair 1. The remote control 95 communicates with control electronics in the controller to adjust the leg support 23, backrest 28, and height of the patient support structure 20. The power for electronic manipulation of the positioning of chair 10 may be supplied by a battery or by common communication with a wall outlet through a power cord (not shown). Preferably both means for supplying power are provided.

Figure 17:
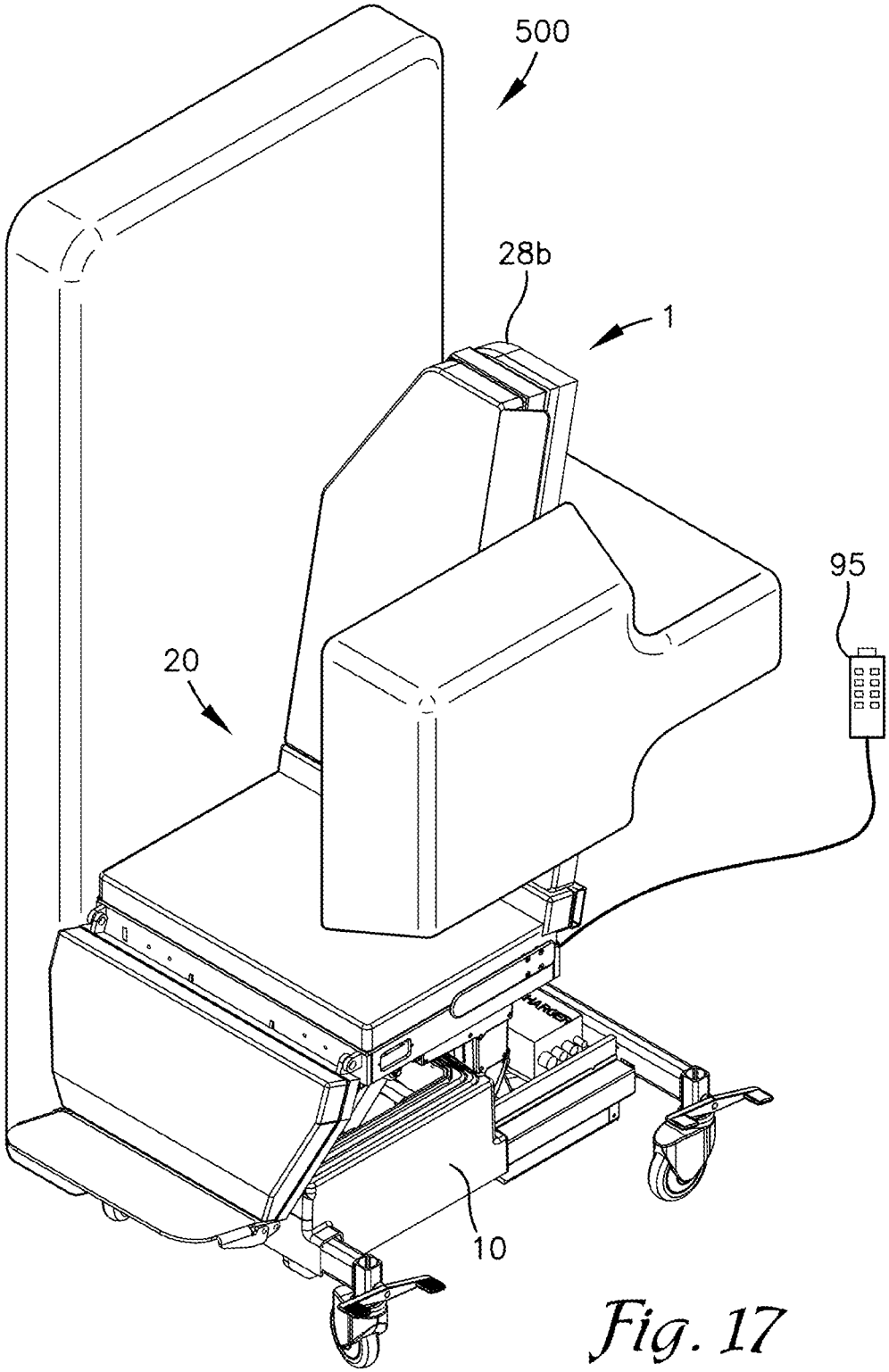
FIG. 17 depicts a perspective view of the use of an embodiment of the medical chair in a radiographic and fluoroscopic machine, wherein the backrest comprises a first and a second section wherein the second section is hingedly attached to the first section, and the second backrest section is rotated to the rear of the chair and behind the first backrest section.

Referring now to FIG. 17, chair 1 of the invention is used in performing radiographic and fluoroscopic procedures on a patient. In FIG. 17, medical chair 1 is shown in a radiographic and fluoroscopic machine 500, positioned in the imaging bay. In FIG. 17 Patient support structure 20 is shown in the 0° position with respect to the base 10, and backrest section **28*b* is shown in the rotated position as shown in FIG. 12. Such an arrangement may be used for lateral imaging of a patient. If antero-posterior, postero-anterior, or dorsal-plantar imaging is desired, the patient support structure 20 of the medical chair 1 may be rotated 90° to the left or to the right relative to the base 10 and positioned in the radiographic and fluoroscopic machine 500 whereby imaging can be performed through the radiolucent backrest 28. Rotating the patient support structure 20 90° to the left or to the right relative to the base 10 maintains proper clearance of the base 10 in relation to the imaging machine, while providing an appropriate angle of exposure for imaging through the radiolucent backrest 28 of the chair 1. It should be understood that if backrest 28 comprises two sections, section 28*a* and section 28*b*, as described above, the backrest sections are in an on plane position to provide optimal exposure through radiolucent windows 74 and 77 as shown in FIG. 11**.

EXAMPLES

The following examples are included to demonstrate the disclosure. It should be appreciated by those of skill in the art that the techniques disclosed in the following examples represent techniques discovered by the inventors to function well in the practice of the disclosure. Those of skill in the art should, however, in light of the present disclosure, appreciate that many changes could be made in the disclosure and still obtain a like or similar result without departing from the spirit and scope of the disclosure, therefore all matter set forth is to be interpreted as illustrative and not in a limiting sense.

Example 1. Transporting a Patient from a Hospital Bed for Radiography and/or Fluoroscopy Procedure In this example, an embodiment of the medical chair of the present disclosure is used to transport a patient from a hospital bed to a radiographic or fluoroscopic machine for a radiography and/or fluoroscopy procedure. The chair, having armrest assemblies folded and tucked into a horizontal storage position in seat section is rolled up to a position adjacent to the patient bed. In this embodiment, the chair comprises casters equipped with a brake system which is engaged to prevent the chair from rolling away from the bed during transfer of the patient to the chair. The scissor lift mechanism is activated by the operator to raise the chair to a height wherein the seat section of the patient support structure is level with the patient bed. The operator also pivots the leg support section and the back rest section to provide a table structure level with the patient bed. It should be noted that the chair is raised to the desired height before or after the leg support section and the back rest section are pivoted to provide a table structure. At this stage, the patient may be safely transferred to the chair for transport to the radiography facility. Depending on the state of the patient, the chair may be returned to a chair configuration before transporting the patient. Alternatively, the chair is returned to a chair configuration after transporting the patient. The footrest may be pivoted to a position generally perpendicular to the plane of the seat section to provide foot support during transfer of a patient when the chair is in a chair configuration. Additionally, when the chair is in a chair configuration, the armrests may be slid out of the seat section and locked in an upright position to secure the patient in the chair and to provide support for the arms of the patient during transfer.

To perform radiographic and fluoroscopic procedures on a patient, the medical chair is positioned in the imaging bay of a radiographic and fluoroscopic machine. Depending on the radiography and fluoroscopy machine and procedure to be performed, the rotatable backrest section of the chair may be in the rotated position as shown in FIG. 12 Throughout this Example, the patient support structure is in the 0° position with respect to the base. Such an arrangement may be used for lateral imaging of a patient. If antero-posterior, postero-anterior, or dorsal-plantar imaging is desired, the patient support structure of the medical chair may be rotated 90° to the left or to the right relative to the base and positioned in the radiographic and fluoroscopic machine whereby imaging can be performed through the radiolucent backrest. Rotating the patient support structure 90° to the left or to the right relative to the base maintains proper clearance of the base in relation to the imaging machine, while providing an appropriate angle of exposure for imaging through the radiolucent backrest of the chair.

Example 2. Transporting a Patient from a Hospital Bed for Radiography and/or Fluoroscopy Procedure In this example, an embodiment of the medical chair of the present disclosure is used to transport a patient. The chair, having armrest assemblies folded and tucked into a horizontal storage position in seat section is rolled up to a patient. In this embodiment, the chair comprises casters equipped with a brake system which is engaged to prevent the chair from rolling away from the bed during transfer of the patient to the chair. The scissor lift mechanism is activated by the operator to lower the chair to a height of about 19 inches from the floor as shown in FIG. 7 in compliance with the specifications set forth by the Americans with Disabilities Act (ADA). To lower the patient support structure of the chair to this low position, the chair is secured in the 0° position with respect to the base to protect chair components from damage. When the patient is safely seated in the chair, the footrest may be pivoted to a position generally perpendicular to the plane of the seat section to provide foot support, and the armrests may be slid out of the seat section and locked in an upright position to secure the patient in the chair and to provide support for the arms of the patient during transfer. The chair may also be partially raised to enable the additional functions of the chair, including rotating the chair about the base and configured to provide a table structure.

What is claimed is:

1. A low clearance mobile medical chair comprising:

a. a base;

b. a patient support structure comprising:

i. a seat section;

ii. a back rest;

iii. a leg support section, wherein the leg support section and the back rest are pivotally secured to the seat section to extend from the seat section at desired angles in relation to the plane of said seat section to provide a chair structure or table structure;

c. a lift mechanism extending upwardly from the base and coupling the base to the patient support structure, wherein the lift mechanism comprises an actuator that functions to adjust the height of the patient support structure; and d. opposed side armrest assemblies that can be moved from a locked support position to a folded and fully retracted horizontal storage position in the seat section;

wherein the back rest comprises a first back section pivotally secured to the seat section, and a second back section hingedly attached to the first back section along a vertical axis, and wherein the second back section is movable independently of the seat section between a first position substantially parallel and on plane with the first backrest section, and a second rotated position placing the second backrest section in a position behind and substantially parallel to the first backrest section.

2. The chair of claim 1, wherein the chair further comprises one or more actuators to adjust the angle of extension of the backrest and leg support section in relation to the plane of the seat section.

3. The chair of claim 1, wherein the base rides on a plurality of caster assemblies.

4. The chair of claim 1, wherein the lift mechanism is a scissor lift mechanism.

5. The chair of claim 1, wherein the lift mechanism allows the seat section to be lowered to a height of about 19 inches from the floor.

6. The chair of claim 1, wherein the back rest is radiolucent.

7. The chair of claim 1, wherein the back rest further comprises a first locking mechanism for securing the second backrest section in the on plane position, and a second locking mechanism for securing the second backrest section in the rotated position.

8. The chair of claim 1, wherein the chair further comprises a swivel assembly connecting the seat section and the lift mechanism for rotation of seat section about its vertical axis on lift mechanism.

9. The chair of claim 1, wherein the chair further comprises one or more limit switches to define the state of orientation of the chair.

10. The chair of claim 9, wherein the one or more limit switches comprise a limit switch for signaling that the chair is in a forward facing, 0° position with respect to the base and a limit switch for signaling if the chair is secured in one of the rotation positions at 0°, 90° left, or at 90° right with respect to the base.

11. A low clearance mobile medical chair comprising:

a. a base that rides on a plurality of caster assemblies;

b. a patient support structure comprising:

i. a seat section;

ii. a back rest;

iii. a leg support section, wherein the leg support section and the back rest are pivotally secured to the seat section to extend from the seat section at desired angles in relation to the plane of said seat section to provide a chair structure or table structure; and c. a lift mechanism extending upwardly from the base and coupling the base to the patient support structure, wherein the lift mechanism comprises an actuator that functions to adjust the height of the patient support structure;

d. a swivel assembly connecting the seat section and the lift mechanism for rotation of seat section about its vertical axis on lift mechanism; and e. opposed side armrest assemblies that can be moved from a locked support position to a folded and fully retracted horizontal storage position in the seat section;

wherein the back rest comprises a first back section pivotally secured to the seat section, and a second back section hingedly attached to the first back section along a vertical axis, and wherein the second back section is movable independently of the seat section between a first position substantially parallel and on plane with the first backrest section, and a second rotated position placing the second backrest section in a position behind and substantially parallel to the first backrest section.

12. The chair of claim 11, wherein the lift mechanism allows the seat section to be lowered to a height of about 19 inches from the floor.

13. The chair of claim 11, wherein the back rest is radiolucent.

14. The chair of claim 11, wherein the back rest further comprises a first locking mechanism for securing the second backrest section in the on plane position, and a second locking mechanism for securing the second backrest section in the rotated position.

15. The chair of claim 11, wherein the chair further comprises one or more limit switches to define the state of orientation of the chair.

16. The chair of claim 14, wherein the one or more limit switches comprise a limit switch for signaling that the chair is in a forward facing, 0° position with respect to the base and a limit switch for signaling if the chair is secured in one of the rotation positions at 0°, 90° left, or at 90° right with respect to the base.

17. A low clearance mobile medical chair comprising:

a. a base;

b. a patient support structure comprising:

i. a seat section;

ii. a back rest;

iii. a leg support section, wherein the leg support section and the back rest are pivotally secured to the seat section to extend from the seat section at desired angles in relation to the plane of said seat section to provide a chair structure or table structure; and c. a lift mechanism extending upwardly from the base and coupling the base to the patient support structure, wherein the lift mechanism comprises an actuator that functions to adjust the height of the patient support structure;

wherein the back rest comprises a first back section pivotally secured to the seat section, and a second back section hingedly attached to the first back section along a vertical axis, and wherein the second back section is movable independently of the seat section between a first position substantially parallel and on plane with the first backrest section, and a second rotated position placing the second backrest section in a position behind and substantially parallel to the first backrest section.

18. The chair of claim 17, wherein the back rest further comprises a first locking mechanism for securing the second backrest section in the on plane position, and a second locking mechanism for securing the second backrest section in the rotated position.

* * * * *